US008550191B2

(12) United States Patent
Hiwasa et al.

(10) Patent No.: US 8,550,191 B2
(45) Date of Patent: Oct. 8, 2013

(54) DIGGING TOOL, DIGGING BIT, AND DEVICE

(75) Inventors: Yoneo Hiwasa, Anpachi-gun (JP); Masaya Hisada, Anpachi-gun (JP); Kazuyoshi Nakamura, Anpachi-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 298 days.

(21) Appl. No.: 12/733,586

(22) PCT Filed: Apr. 22, 2008

(86) PCT No.: PCT/JP2008/057716

§ 371 (c)(1),
(2), (4) Date: Mar. 10, 2010

(87) PCT Pub. No.: WO2009/034740

PCT Pub. Date: Mar. 19, 2009

(65) Prior Publication Data

US 2010/0200302 A1 Aug. 12, 2010

(30) Foreign Application Priority Data

Sep. 11, 2007 (JP) ..... 2007-235250

(51) Int. Cl.
*E21B 10/60* (2006.01)

(52) U.S. Cl.
USPC ..... 175/393; 175/417; 175/418

(58) Field of Classification Search
USPC ..... 175/393, 417, 418, 324, 296, 414, 415
See application file for complete search history.

(56) References Cited

U.S. PATENT DOCUMENTS 5,590,726 A 1/1997 Jarvela et al.
8,347,988 B2 * 1/2013 Gilbert et al. ..... 175/293

FOREIGN PATENT DOCUMENTS

CN 1055792 A 10/1991
CN 1090367 A 8/1994
JP 3726179 2/2001

(Continued)

OTHER PUBLICATIONS

"JP 2003-172089 A—Hayashi et al.: JPO AIPN Machine Translation", Translated May 10, 2012 via JPO AIPN.*
"JP 2006-037613 A—Tanaka et al.: JPO AIPN Machine Translation", Translated May 10, 2012 via JPO AIPN.*

(Continued)

*Primary Examiner* — Giovanna Wright
*Assistant Examiner* — Richard Alker
(74) *Attorney, Agent, or Firm* — Edwards Wildman Palmer LLP

(57) ABSTRACT

Provided is an excavation tool for efficiently taking waste rocks produced during excavation into the inner peripheral side of a casing pipe. An excavation tool (10) includes a casing shoe (11), a casing pipe (15), a rod (60), a device (40), and an excavation bit (20). The excavation bit (20) has a head portion (22) and a skirt portion (23). The head portion (22) is provided with: a face flute (27), which is open into the tip face of the head portion and extends radially outward; a connection flute (28), which is integrally connected to the outer peripheral end of the face flute (27) and extends toward the rear end side, and an intake hole (29), which is integrally connected with the discharge flute (46) of the device (40) and is open to the inner peripheral side of the skirt portion (23) from the connection flute (28).

13 Claims, 11 Drawing Sheets

(56) References Cited

FOREIGN PATENT DOCUMENTS

| | | | | |
|---|---|---|---|---|
| JP | 2001032664 | A | | 2/2001 |
| JP | 2001-140578 | A | | 5/2001 |
| JP | 3903881 | | | 6/2003 |
| JP | 2003172089 | A | * | 6/2003 |
| JP | 2006037613 | A | * | 2/2006 |
| WO | WO-9618798 | | | 6/1996 |

OTHER PUBLICATIONS

JP 2006-037613 A—Tanaka et al : Official Translation. Translated May 2012 by FLS, Inc.*

International Search Report dated Aug. 5, 2008, issued on PCT/JP2008/057716.

The extended European search report issued Jan. 28, 2013 for EP Application No. 08751901.3.

* cited by examiner

DIGGING TOOL, DIGGING BIT, AND DEVICE

TECHNICAL FIELD

The present invention relates to a so-called double tubing bit type excavation tool which bores an excavation hole in a rock, etc. and builds a casing pipe into the excavation hole; and an excavation bit and a device used with the excavation tool.

BACKGROUND ART

Generally, a double tubing bit type excavation tool, in which an excavation bit is mounted on the tip of a rod inserted into a cylindrical casing pipe, is frequently used for boring an excavation hole in a rock, etc. In this type of excavation tool, the rod transmits rotational force, thrust, and impact to the excavation bit to perform the excavation operation. In addition, a casing pipe is built into an excavation hole to prevent the excavation hole from collapsing (for example, refer to Patent Documents 1 and 2).

In detail, the excavation tool includes:

a casing shoe to which the thrust and impact are transmitted in the direction of an axis;

a casing pipe connected to the rear end of the casing shoe;

a rod, by which the thrust and the impact are transmitted in the direction of the axis together with the rotational force, arranged coaxially inside the casing pipe;

a device attached to a tip portion of the rod; and an excavation bit, which is mounted on the tip of the device by restraining the rotation relative to the device.

The rotational force, thrust, and impact given by the rod make the excavation bit bore an excavation hole; and concurrently the casing pipe is built into the excavation hole.

In such an excavation tool, waste rocks produced during excavation must be discharged to the outside of the excavation hole.

For example, Patent Document 1 discloses an excavation bit in which an intake hole for discharging the waste rocks is open into the vicinity of the center of the tip face. The waste rocks are taken into the intake hole, and is discharged to the inner peripheral side of the casing pipe through the intake hole.

Additionally, Patent Document 2 discloses an excavation bit wherein a face flute, which extends radially outward, is formed in the tip face; and a flute portion, which is integrally connected to an outer peripheral end of the face flute and extends toward the axial rear end side, is formed in the outer peripheral surface of the excavation bit.

In this excavation bit; the waste rocks are taken into the inner peripheral side of a casing pipe through the gap between the flute portion and the casing shoe, and is discharged to the outside of an excavation hole.

[Patent Document 1] Japanese Patent No. 3726179

[Patent Document 2] Japanese Patent No. 3903881

DISCLOSURE OF THE INVENTION

Problems that the Invention is to Solve

Meanwhile, the excavation tool disclosed in Patent Document 1 has an intake hole which takes the waste rocks into the inner peripheral side of the casing pipe and is open into the vicinity of the center of the tip face of the excavation bit.

Since centrifugal force generated by the rotation of the excavation tool moves radially outward the waste rocks, the waste rocks cannot be taken into the inner peripheral side of the casing pipe. Therefore, a problem, in which the waste rocks cannot be efficiently discharged, arises.

Additionally, the excavation tool disclosed in Patent Document 2 has a tip face of the excavation bit and also the face flute which extends radially outward and which is formed in the tip face. Further, this excavation tool has the flute portion formed in the outer peripheral surface of the excavation bit.

Therefore, the centrifugal force generated by the rotation of the excavation tool moves the waste rocks radially outward, and then the waste rocks can be taken from the face flute through the flute portion of the outer peripheral surface into the inner peripheral side of the casing shoe.

However, in this formation, there is a possibility that some of the waste rocks may enter a space between the inner peripheral surface of the excavation hole and the casing shoe or the casing pipe. Thereby, risks of increasing excavation resistance and/or of damaging the excavation hole, the casing shoe, and/or the casing pipe are incurred. Then there is a possibility that the casing pipe cannot be built into the excavation hole.

The invention was made in view of the aforementioned situations, and the object thereof is to provide;

an excavation tool for efficiently taking waste rocks produced during excavation into the inner peripheral side of a casing pipe, and for discharging the waste rocks to the outside;

and an excavation bit and a device which are used with the excavation tool.

Means for Solving the Problems

In order to solve such problems and achieve the above object, an excavation tool of the invention includes an excavation bit arranged on a tip portion of a casing pipe; and a device which is arranged inside the casing pipe and the excavation bit coaxial to an axis, and receives impact, thrust, and rotational force from an excavation apparatus.

The device has a discharge flute, which is for discharging waste rocks produced during excavation and is formed in the outer peripheral surface along an axis toward a rear end side; and also has a fluid supply hole which extends along the axis.

The excavation bit includes a skirt portion which receives the rotational force, thrust, and impact from the device;

a fluid discharge hole, which is connected to the fluid supply hole of the device and is open into the tip face of the excavation bit;

a face flute, which is formed in the tip face of the excavation bit and extends radially outward;

a connection flute which is formed in an outer peripheral surface of the excavation bit, is integrally connected to an outer peripheral end of the face flute, and extends toward the axial rear end side; and an intake hole, which is open from the connection flute into the inner peripheral side of the skirt portion and is connected to the discharge flute of the device.

In the excavation tool of this construction, the face flute, which extends radially outward, is formed in the tip face of the excavation bit.

Thus, the centrifugal force generated by the rotation of the excavation tool and/or the flow of a fluid discharged from the fluid discharge hole can move the waste rocks produced during excavation to the outer peripheral side of the excavation bit through the face flute. The waste rocks is taken into the discharge flute of the device through the connection flute and the intake hole, which are integrally connected to the outer peripheral ends of the face flute and extend toward the axial rear end side.

Further, the waste rocks are discharged to the outside of the excavation hole through the inside of the casing pipe behind the discharge flute. In this way, it is possible to efficiently discharge the waste rocks produced during excavation to the outside of the excavation hole.

Here, a shield wall, which greatly extends radially outward beyond the casing shoe, may be formed at the rear end of the connection flute.

The shield wall can prevent the waste rocks, which pass through the gap between the connection flute and the excavation hole, from entering a space between the outer peripheral surface of the casing pipe and the inner peripheral surface of the excavation hole.

Thus, increasing of the excavation resistance, and/or damaging of the excavation hole and/or of the casing pipe can be effectively prevented. Therefore, a reliable performance of building the casing pipe into the excavation hole can be carried out.

Additionally, the device may be provided with a fluid emission hole; which gradually goes toward the axial rear end side in proportion as the fluid emission hole goes radially outward from the fluid supply hole, and is open into the discharge flute.

In this case, the flow of a fluid emission from the fluid emission hole enables waste rocks to be easily taken into the discharge flute of the device through the connection flute and through the intake hole. Thus, discharging of the waste rocks can be hastened further.

Moreover, the fluid emission hole may be located inward in the inner periphery side of the skirt portion of the excavation bit.

In this case, the fluid emission hole is provided in the vicinity of the tip face of the excavation bit. Also the fluid emission hole gradually goes toward the axial rear end side in proportion as it goes radially outward from the fluid supply hole, and is open into the discharge flute. Thus, the flow of a fluid emission from the fluid emission hole can make the waste rocks removal efficient.

Moreover, an excavation bit of the invention is an excavation bit used with the aforementioned excavation tool.

The excavation bit includes a skirt portion which receives the rotational force, thrust, and impact from the device;

a fluid discharge hole, which is connected to the fluid supply hole of the device and is open into a tip face of the excavation bit;

a face flute, which is formed in the tip face of the excavation bit and extends radially outward;

a connection flute which is formed in an outer peripheral surface of the excavation bit, is integrally connected to an outer peripheral end of the face flute, and extends toward the axial rear end side; and an intake hole which is open from the connection flute into the inner peripheral side of the skirt portion.

Further, a device of the invention is a device used with the aforementioned excavation tool.

The device includes a loading portion, which is formed at the tip of the device and is to be inserted into a skirt portion of an excavation bit;

a discharge flute which is for discharging the waste rocks produced during excavation, goes toward the axial rear end side, and is provided in an outer peripheral surface of the device;

a fluid supply hole which extends along the axis; and a fluid emission hole which gradually goes toward the axial rear end side in proportion as the fluid emission hole goes radially outward from the fluid supply hole, is open into the discharge flute, and is provided in the loading portion.

The excavation tool of the invention mentioned above can be constructed by using the excavation bit and device of the invention having such a construction.

Advantage of the Invention

According to the invention, it is possible to provide an excavation tool for taking waste rocks produced during excavation efficiently into the inner peripheral side of a casing pipe and for discharging the waste rocks to the outside; in addition, it is possible to provide an excavation bit and a device used with the excavation tool.

DESCRIPTION OF REFERENCE NUMERALS AND SIGNS

10, 110, 210, 310, 410, 510, 610: EXCAVATION TOOL
11, 111, 211, 311, 511, 611: CASING SHOE
15, 115, 215, 315, 415, 515, 615: CASING PIPE
20, 120, 220, 320, 420, 520, 620: EXCAVATION BIT
23, 123, 223, 323, 423, 523, 623: SKIRT PORTION
27, 127, 227, 327, 427, 527, 627: FACE FLUTE
28, 128, 228, 328, 428, 528, 628: CONNECTION FLUTE
29, 129, 229, 329, 429, 529, 629: INTAKE HOLE
31, 131, 231, 331, 431, 531, 631: FLUID DISCHARGE HOLE
35, 135, 235, 335, 435, 535, 635: SHIELD WALL
40, 140, 240, 340, 440, 540, 640: DEVICE
41, 141, 241, 341, 441, 541, 641: MOUNTING SHAFT PORTION (LOADING PORTION)

46, 146, 246, 346, 446, 546, 646: DISCHARGE FLUTE
49, 149, 249, 349, 449, 549, 649: FLUID SUPPLY HOLE
50, 150, 250, 350, 450, 550, 650: FLUID EMISSION HOLE

BEST MODE FOR CARRYING OUT THE INVENTION

Hereinafter, an excavation tool that is an embodiment of the invention will be described with reference to the attached drawings.

Figure 1:
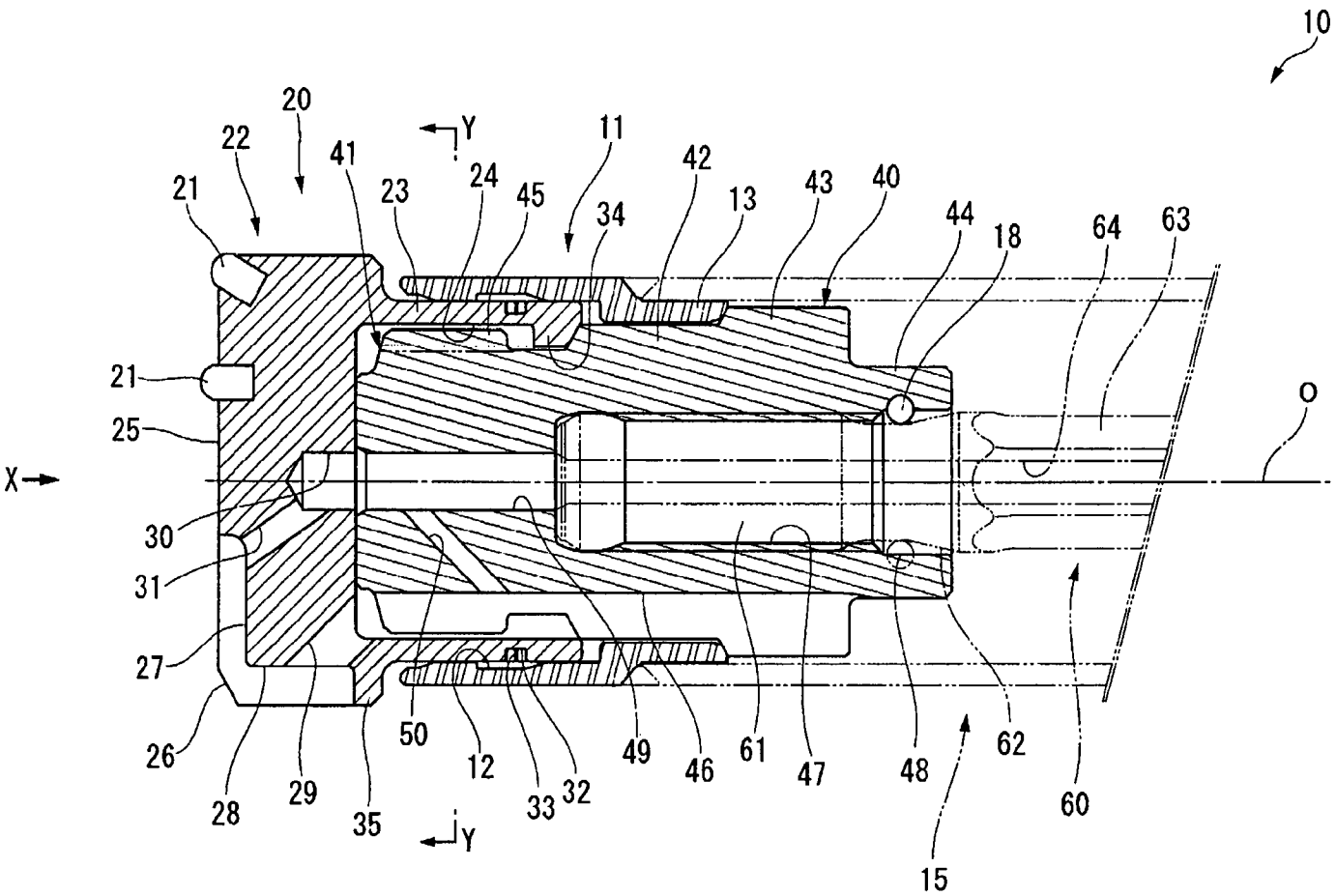
FIG. 1 is a partial side sectional view of an excavation tool that is an embodiment of the invention.

An excavation tool 10, as shown in FIG. 1, includes a device 40, which is shaped in substantially cylindrical tiers and extends along a central axis O;

an excavation bit 20 mounted on the tip (the left in FIG. 1) of the device 40;

a rod 60 inserted into the rear end of the device 40;

a casing shoe 11 fitted onto the outer peripheral portions of the excavation bit 20 and the device 40; and a casing pipe 15 connected to the rear end of the casing shoe 11.

Figure 4:
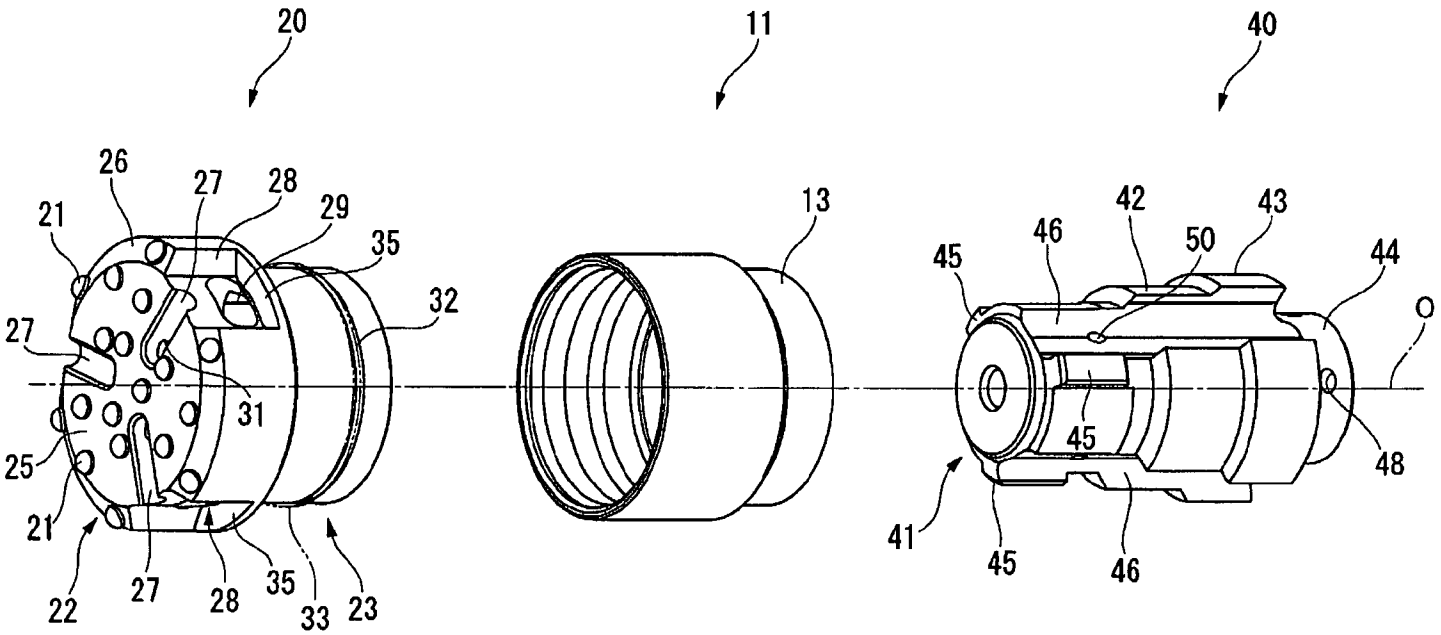
FIG. 4 is an exploded perspective view of an excavation bit, device, and casing shoe of the excavation tool shown in FIG. 1.
Figure 5:
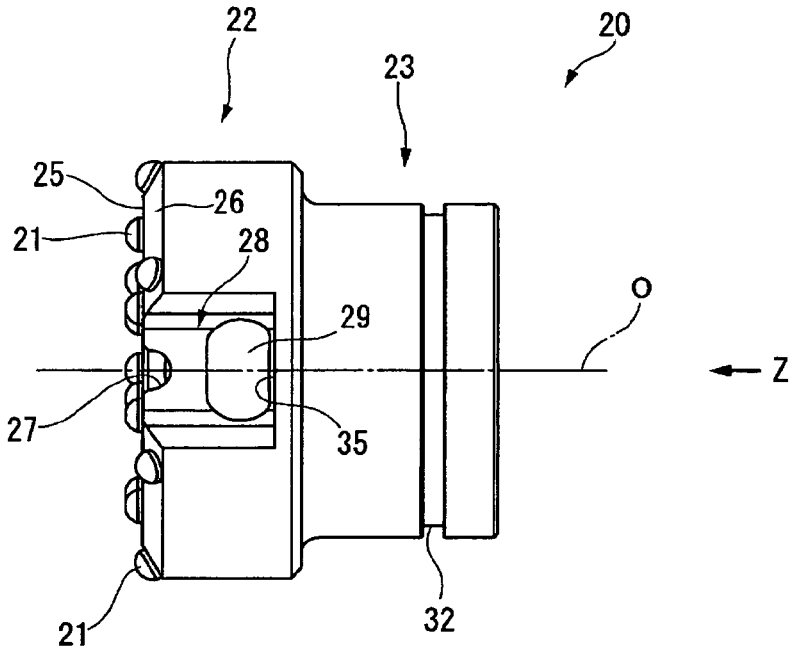
FIG. 5 is a side view of the excavation bit shown in FIG. 4.
Figure 6:
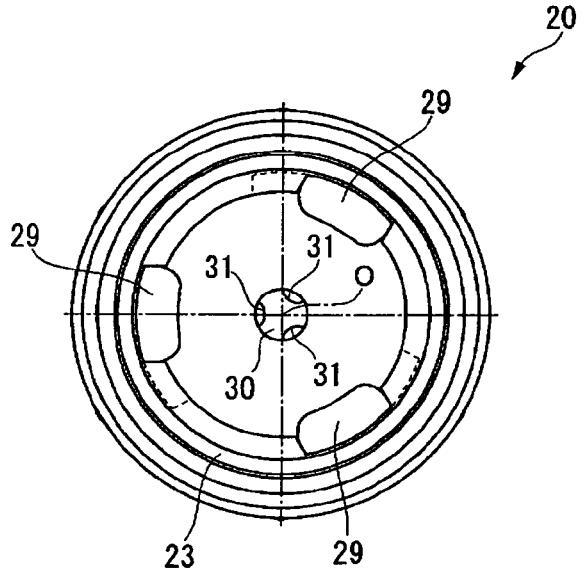
FIG. 6 is a view as seen from the direction Z in FIG. 5.

The casing shoe 11, as shown in FIGS. 1 and 4, is shaped in substantially cylindrical tiers and has a construction which can fit onto the outer peripheral portions of the excavation bit 20 and the device 40. Further, when receiving the impact from the device 40, the casing shoe 11 gets a driving force.

A locking recess 12 which is concave radially outward and also is circular, namely, ring-shaped, is formed at the tip portion of the casing shoe 11.

A connecting portion 13, where the external diameter and the internal diameter are one-tier smaller than those of other portions, is provided in the rear end of the casing shoe 11. The casing pipe 15 is connected to the connecting portion 13.

The casing pipe 15 has a cylindrical shape; in which its external diameter is approximately equal to or smaller than that of the tip portion of the casing shoe 11, and its internal diameter is approximately equal to the external diameter of the connecting portion 13 in the casing shoe 11.

In addition, a tip portion of the casing pipe 15 is welded to the casing shoe 11 in a state of fitting the casing pipe 15 onto the connecting portion 13 of the casing shoe 11.

Figure 2:
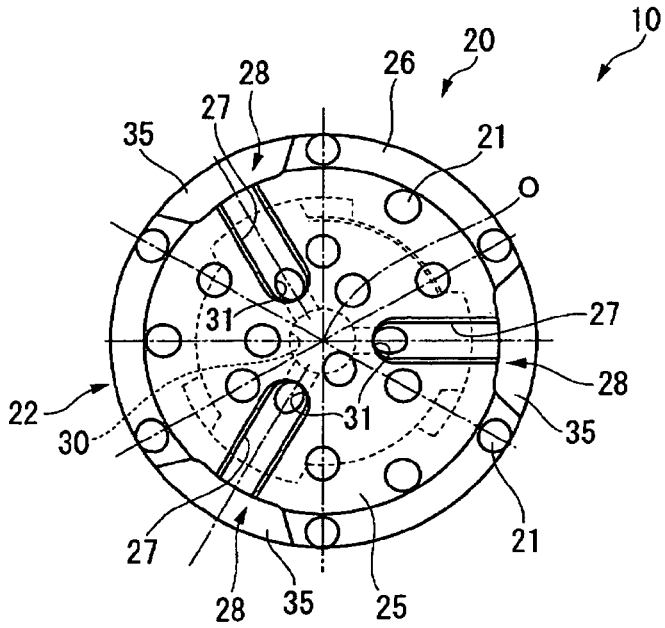
FIG. 2 is a view as seen from the direction X in FIG. 1.
Figure 3:
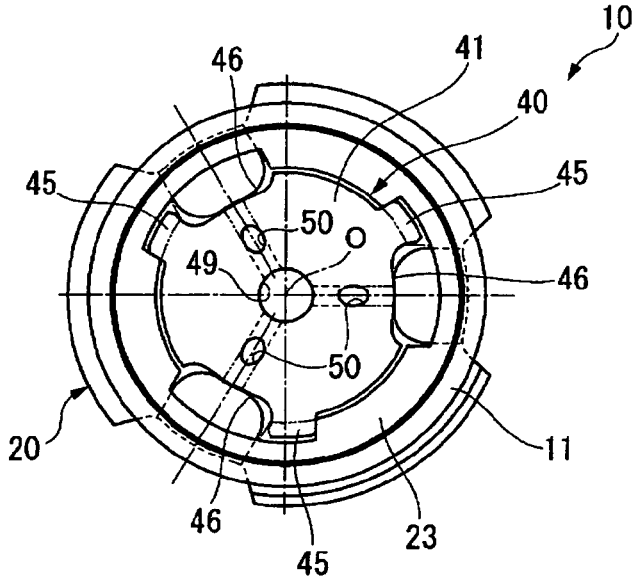
FIG. 3 is a sectional view taken along the line Y-Y in FIG. 1.

As shown in FIGS. 1 to 3, the excavation bit 20 includes a substantially cylindrical head portion 22 in which a plurality of tips 21 made of a hard material, such as a cemented carbide, is implanted; and a skirt portion 23, which is connected to the rear end of the head portion 22 and extends along the central axis O.

A mounting hole 24 is open at the rear end side of the excavation bit 20. The mounting hole 24, into which the device 40 can be inserted, is provided. The device 40 will be described later.

The head portion 22 includes a flat surface portion 25 which extends in a direction perpendicular to the central axis O; and a tapered surface portion 26, which is integrally connected to the outer peripheral end of the flat surface portion 25 and goes gradually toward the rear end side in proportion as it goes radially outward.

A plurality of tips 21 is implanted in the flat surface portion 25 and the tapered surface portion 26, respectively.

Face flutes 27, which are open into the tip side and extend radially outward from the vicinity of the central axis O, are formed in the flat surface portion 25.

In addition, in this embodiment, as shown in FIG. 2 and FIG. 4, three face flutes 27 are arranged at intervals of 120° radially in the peripheral direction.

Additionally, connection flutes 28, which are open radially outward and extend parallel to the central axis O, are formed in the outer peripheral surface of the head portion 22.

Each connection flute 28 is formed by cutting out a part of the tapered surface portion 26, and is connected to the outer peripheral end of each face flute 27.

In this embodiment, three connection flutes 28 are provided at intervals of 120° radially in the peripheral direction so as to be connected to the outer peripheral ends of the three face flutes 27, respectively. As shown in FIG. 1, a shield wall 35, which extends radially outward beyond the external diameter of the casing shoe 11, is formed at the rear end of each connection flute 28.

As shown in FIG. 1, an intake hole 29, which gradually goes radially inward in proportion as it goes toward the rear end side, is open into the rear end of each connection flute 28. In other words, the intake hole 29 inclines toward the central axis O.

In addition, in this embodiment, the cross-section, which is perpendicular to the extension direction of the intake hole 29, shows that the intake hole 29 has a substantially elliptical shape.

Additionally, a stop hole 30, which is open into the bottom face of the mounting hole 24 and extends along the central axis O; and a fluid discharge hole 31, which is integrally connected to the stop hole 30 and is open into the inner peripheral end of each face flute 27;

are formed at the head portion 22.

The skirt portion 23 has a substantially cylindrical shape; in which its external diameter is one-tier smaller than that of the head portion 22, and is set to be approximately equal to the internal diameter of a portion where the locking recess 12 of the aforementioned casing shoe 11 is formed.

An annular recess 32 is formed in the outer peripheral surface of the skirt portion 23.

A retaining ring 33, of which the diameter is flexible due to elastic deformation, is fitted into the annular recess 32.

Additionally, engaging projections 34, which protrude toward the inner peripheral side of the mounting hole 24, is formed at the rear end of the skirt portion 23. Each engaging projection 34 is partially located at a radially different position from the position where each rear end of the aforementioned intake hole 29 is formed.

Figure 7:
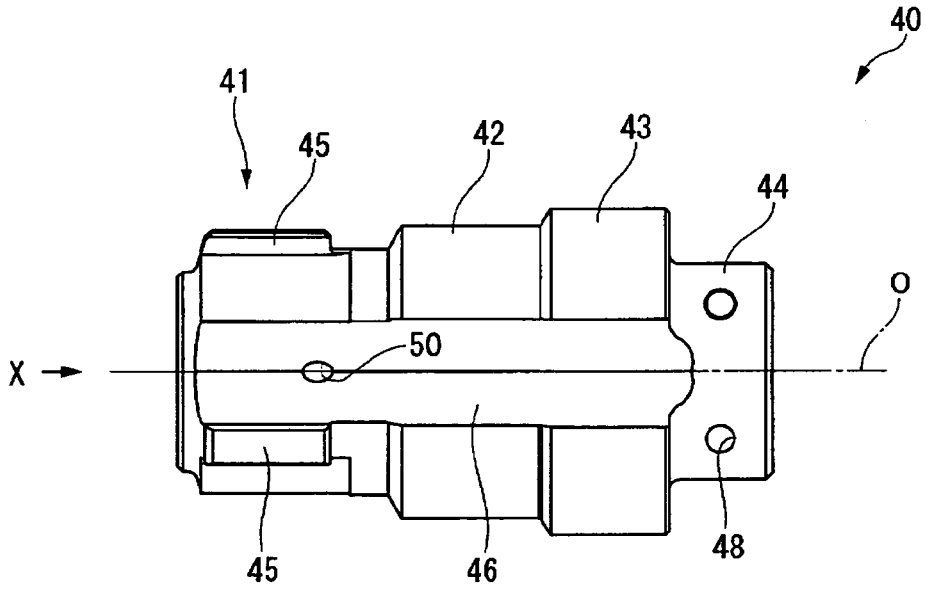
FIG. 7 is a side view of the device shown in FIG. 4.
Figure 8:
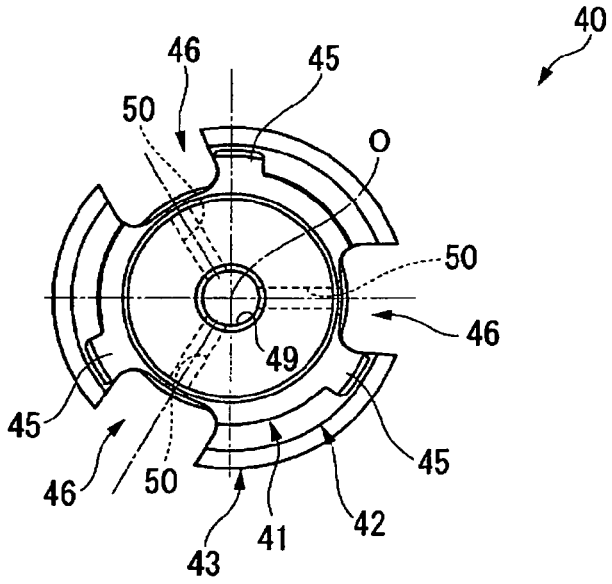
FIG. 8 is a view as seen from the direction X in FIG. 7.

Next, the device 40 will be described. As shown in FIGS. 1, 7, and 8, the device 40 has a shape, which is in substantially cylindrical tiers and extends along a central axis O.

Further the device 40 includes a mounting shaft portion 41, which can be fitted into the mounting hole 24 of the aforementioned excavation bit 20;

a main body 42, which is integrally connected to the rear end of the mounting shaft portion 41 and has a diameter equal to or one-tier larger than that of the mounting shaft portion 41;

a large diameter portion 43, which is integrally connected to the rear end of the main body 42 and has a diameter one-tier larger than that of the main body 42; and a small diameter portion 44, which is integrally connected to the rear end of the large diameter portion 43 and has a diameter smaller than that of the large diameter portion 43.

The mounting shaft portion 41 is provided with engaging portions 45 which protrude radially outward.

In this embodiment, as shown in FIG. 8, three engaging portions 45 are arranged with the constant intervals of 120° radially around the central axis O.

Each engaging portion 45 has a construction which enables each engaging portion 45 to engage with each engaging projection 34 formed in the mounting hole 24 of the aforementioned excavation bit 20.

That is, in the mounting shaft portion 41, the external diameter of a section where the engaging portion 45 is not arranged, is smaller than the internal diameter of the mounting hole 24 where the engaging projection 34 is arranged; and also the external diameter of a section where the engaging portion 45 is arranged, is greater than the internal diameter of the mounting hole 24 where the engaging projection 34 is arranged, and is smaller than the internal diameter of the mounting hole 24 where the engaging projection 34 is not arranged.

Additionally, the length of the engaging portion 45 along the central axis O is set to be smaller than the length between the bottom face of the mounting hole 24 and the tip face of the engaging projection 34 along the central axis O.

The external diameter of the main body 42, as shown in FIG. 1, is greater than the internal diameter of the mounting hole 24 of the excavation bit 20 where the engaging projection 34 is arranged, and is set to be approximately equal to the internal diameter of the connecting portion 13 of the aforementioned casing shoe 11.

A ramp portion located between the main body 42 and the mounting shaft portion 41 has a construction which abuts on the rear end of the engaging projection 34 of the excavation bit 20.

That is, in the engaging projection 34 of the excavation bit 20, the tip side engages with the engaging portion 45 provided on the mounting shaft portion 41, and also the rear end side engages with the ramp portion located between the main body 42 and the mounting shaft portion 41.

Therefore, the construction enables the device 40 and the excavation bit 20 to slide on each other in the direction of the central axis O.

The external diameter of the large diameter portion 43, as shown in FIG. 1, is set to be greater than the internal diameter of the connecting portion 13 of the casing shoe 11, and is set to be slightly smaller than the internal diameter of the casing pipe 15 connected to the rear end of the casing shoe 11.

The ramp portion located between the large diameter portion 43 and the main body 42 has a construction, which abuts on the rear end of the casing shoe 11 and can transmit the impact and thrust from the rod 60 to the casing shoe 11.

Discharge flutes 46, which extend parallel to the central axis O and go from the tip face of the mounting shaft portion 41 to the rear end surface of the large diameter portion 43, are formed in the outer peripheral surface of the device 40.

In this embodiment, as shown in FIG. 8, three discharge flutes 46 are arranged with the constant intervals of 120° radially around the central axis O.

Additionally, as shown in FIG. 1, an insertion hole 47 is formed in the device 40. The insertion hole 47 is open into the rear end surface of the small diameter portion 44, extends along the central axis O, and goes to the rear end of the mounting shaft portion 41. The inner peripheral surface of the insertion hole 47 is provided with a female screw. Additionally, a pin hole 48, into which a locking pin 18 fits, is arranged in the vicinity of an opening end of the insertion hole 47. The locking pin 18 locks the rod 60 inserted into the insertion hole 47.

As shown in FIG. 1, a fluid supply hole 49, which is open into the tip face of the device 40 and goes along the central axis O, is connected to the tip of the insertion hole 47.

Additionally, fluid emission holes 50 are provided in the mounting shaft portion 41.

The fluid emission holes 50 gradually go to the rear end side in proportion as they extend radially outward from the fluid supply hole 49, and are open into the bottoms of the discharge flutes 46, respectively.

In this embodiment, as shown in FIG. 8, three fluid emission holes 50 are arranged with the constant intervals of 120° radially around the central axis O.

As shown in FIG. 1, the rod 60 includes, an insertion shaft portion 61 having a construction, in which the diameter of its tip side is one-tier smaller than those of other sections, and is able to be inserted into the insertion hole 47 of the device 40;

a shoulder 62, in which its external diameter becomes larger gradually toward the rear end side; and a rod body 63, which is integrally connected to the rear end of the shoulder 62 and has a hexagonal shape in cross section.

The outer peripheral surface of the insertion shaft portion 61 is provided with a male screw. Additionally, a fluid hole 64, which extends along the central axis O and is open into the tip face, is formed in the rod 60.

The insertion shaft portion 61 of the rod 60 is inserted into the insertion hole 47 of the device 40, and is locked by the locking pin 18.

In this situation, the tip face of the rod 60 closely contacts the bottom face of the insertion hole 47, and then the fluid hole 64 and the fluid supply hole 49 are connected to each other.

When fitting the mounting shaft portion 41 provided at the tip of the device 40 into the mounting hole 24 of the excavation bit 20, the engaging projection 34 and the engaging portion 45 are engaged with each other, and then the device 40 and the excavation bit 20 are also connected with each other. In this situation, the device 40 and the excavation bit 20 can slide slightly on each other in the direction of the central axis O.

In this situation, as shown in FIGS. 2 and 3, the peripheral positions of the device 40 and of the excavation bit 20 are relatively determined, to have a placement in which the connection flutes 28 formed in the excavation bit 20 and the discharge flutes 46 provided in the device 40 are placed radially in the same directions, respectively.

Additionally, the tip face of the mounting shaft portion 41 closely contacts the bottom face of the mounting hole 24, and then the fluid supply hole 49 and the stop hole 30 are connected with each other.

When fitting the tip portion of the casing shoe 11 onto the skirt portion 23 of the excavation bit 20, the locking recess 12 of the casing shoe 11 engages with the retaining ring 33 housed in the annular recess 32 of the skirt portion 23, and then the casing shoe 11 and the excavation bit 20 are connected with each other. In this situation, the casing shoe 11 and the excavation bit 20 can slide slightly on each other in the direction of the central axis O. The excavation tool 10 that is this embodiment is constructed in this manner.

An impact apparatus and a rotational driving apparatus, with which an excavation machine (not shown) is equipped, drive the excavation tool 10.

Rotational force, impact, and thrust are transmitted to the excavation tool 10.

The excavation bit 20 arranged at the tip of the excavation tool 10 breaks an object to be excavated, such as a rock, and bores an excavation hole. Further, the casing pipe 15 is built into the excavation hole.

Concurrently, a fluid, for example air which is from the excavation machine, passes through the fluid hole 64 of the rod 60, and also passes through the fluid supply hole 49 of the device 40; is supplied to the tip side of the excavation tool 10.

In the excavation tool 10 that is this embodiment, the face flutes 27, which extend radially outward, are formed in the tip face of the head portion 22 of the excavation bit 20.

Thus, the centrifugal force generated by the rotation of the excavation tool 10, and/or the flow of a fluid discharged from the fluid discharge hole 31 through the stop hole 30 into the fluid supply holes 49; can make the waste rocks produced during excavation move to the outer peripheral side of the head portion 22 through the face flutes 27.

Further, the fluid emission holes 50, which gradually go toward the rear end side along the central axis O in proportion as it goes radially outward, and are open into the discharge flutes 46, are provided in the device 40.

Thus, the flow of the fluid emitted from the fluid emission holes 50 makes the waste rocks move into the discharge flutes 46 formed in the outer peripheral surface of the device 40. Then, the waste rocks passes through the connection flutes 28, which are integrally connected to the outer peripheral ends of the face flutes 27 and extend toward the rear end side, and also pass through the intake holes 29 formed at the rear end of the connection flutes 28. Then, the waste rocks is discharged to the rear end side.

Additionally, the waste rocks is easily taken into the discharge flutes of the device through the connection flutes 28 and through the intake holes 29. Thus, discharging of the waste rocks can be hastened further.

The shield walls 35, which greatly extend radially outward beyond the casing shoe 11, are provided at the rear ends of the connection flutes 28 in the outer peripheral surface of the head portion 22.

The shield walls 35 can prevent the waste rocks, which passes through the gaps between the connection flutes 28 and the inner peripheral surface of an excavation hole, from entering a space between the outer peripheral surface of the casing shoe 11 and the inner peripheral surface of the excavation hole.

Thus, increasing of the excavation resistance, and/or damaging of the excavation hole, the casing shoe 11, and/or the casing pipe 15 can be effectively prevented. Therefore, a reliable performance of building the casing pipe 15 into the excavation hole can be carried out.

The fluid emission holes 50 are formed in the mounting shaft portion 41 of the device 40.

The mounting shaft portion 41 is located inward in the inner peripheral side of the skirt portion 23 of the excavation bit 20. Also, the fluid emission holes 50 are arranged in the vicinity of the head portion 22 of the excavation bit 20.

Therefore, the flow of a fluid emission, such as air, from the fluid emission holes 50 can make the waste rocks be taken efficiently into the discharge flutes 46 of the device 40. Then, the waste rocks can be discharged more efficiently to the outside of an excavation hole.

Although the excavation tool that is an embodiment of the invention has been described hitherto, the invention is not limited thereto, and appropriate changes can be made without departing from the technical idea of the invention.

For example, in the aforementioned description, the discharge flutes, the face flutes, the connection flutes, and the intake holes are three, and are arranged with the constant intervals radially in the peripheral direction, respectively.

However, the invention is not limited to such a construction.

Preferably, the number and/or arrangement of the discharge flutes, the face flutes, the connection flutes, and the intake holes are appropriately set in consideration of the size or the like of an excavation hole to be excavated.

Figure 9:
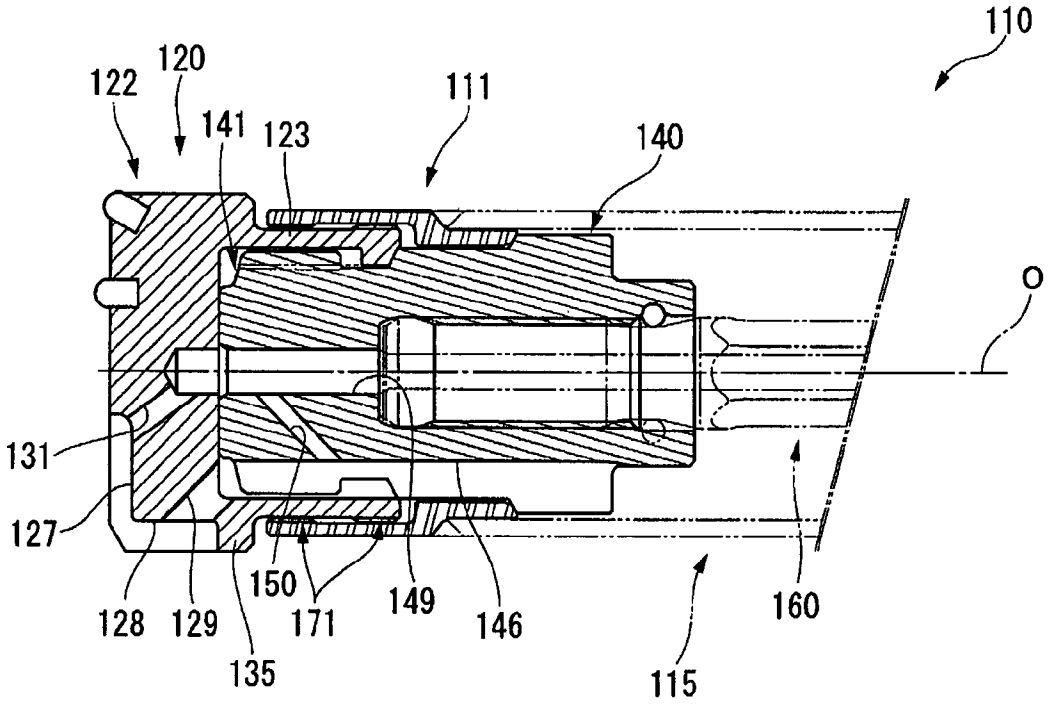
FIG. 9 is a partial side sectional view of an excavation tool that is another embodiment of the invention.

Additionally, the locking structure, by which the excavation bit and the casing shoe engage with each other, is not limited to this embodiment and can be appropriately changed. For example, in an excavation tool 110 shown in FIG. 9, screws 171 make a casing shoe 111 and an excavation bit 120 connect to each other. This manner is also usable.

Additionally, the shapes of the excavation bit and the device are not limited to this embodiment, and can be appropriately changed according to the situation during excavation.

In the aforementioned description, the rear end of the rod has a hexagonal shape in cross-section. However, the invention is not limited to this shape. The rear end of the rod having a prismatic shape or a cylindrical shape is also usable.

Also, the invention is not limited to the excavation tool having a rod.

Figure 10:
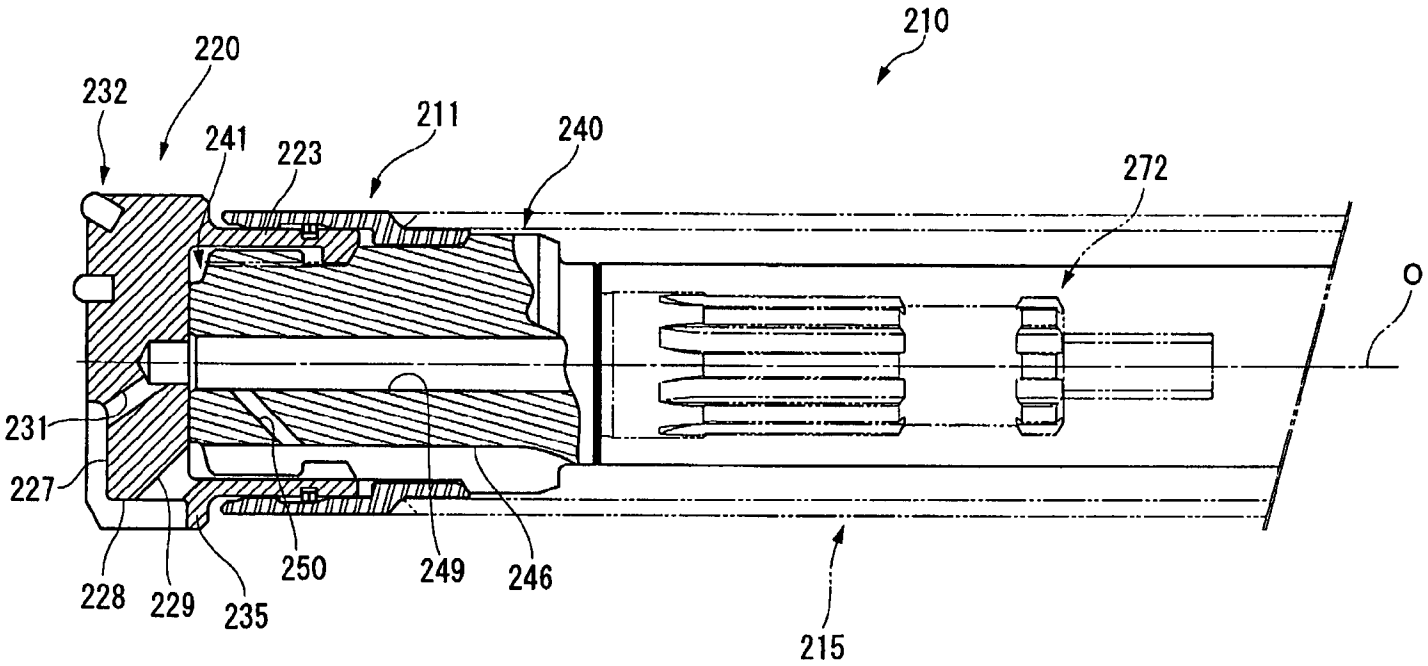
FIG. 10 is a partial side sectional view of an excavation tool that is still another embodiment of the invention.

For example, FIG. 10 shows that an excavation tool 210 has a construction in which a device 240 is mounted on a down-the-hole drill 272. Such construction is also usable.

Additionally, in the aforementioned description, the device transmits impact to the casing shoe.

Figure 11:
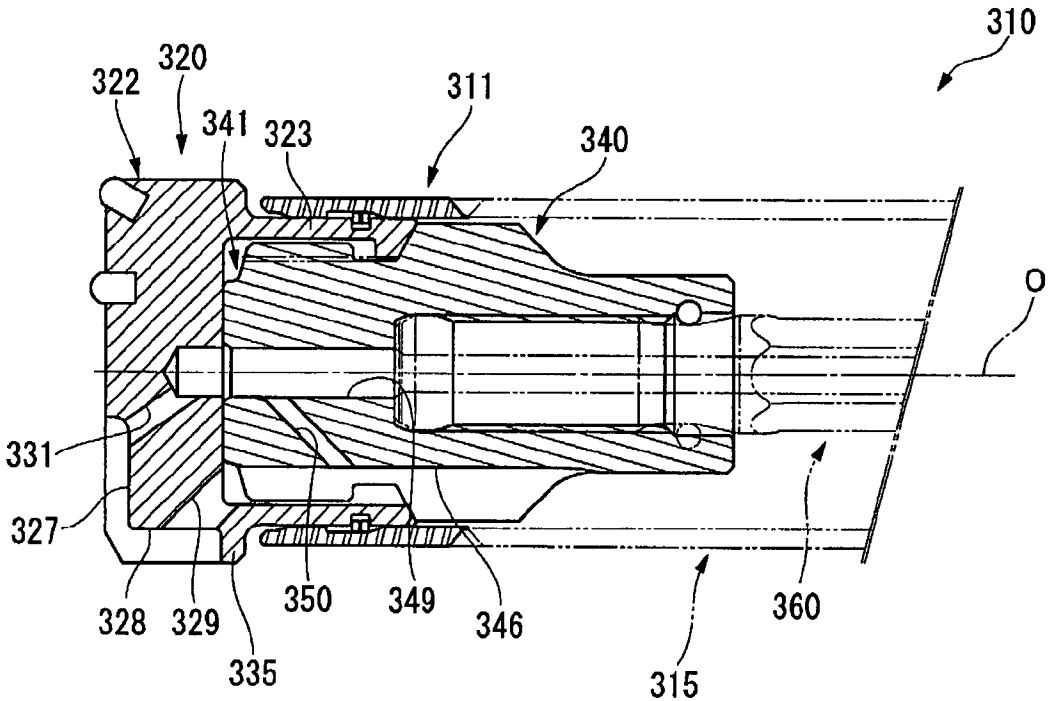
FIG. 11 is a partial side sectional view of an excavation tool that is a still further embodiment of the invention.

For example, FIG. 11 shows that an excavation tool 310 has a construction in which impact is not transmitted to a casing shoe 311 and a casing pipe 315. Such construction is also usable.

Figure 12:
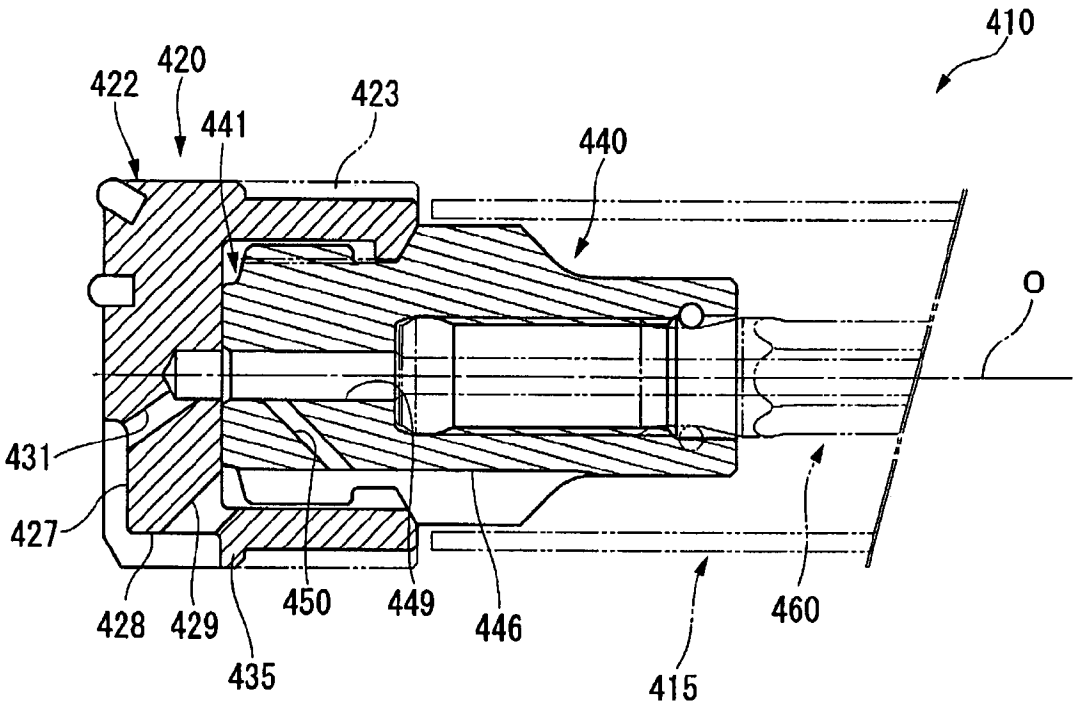
FIG. 12 is a partial side sectional view of an excavation tool that is a still further embodiment of the invention.

Also, in the aforementioned description, the excavation tool is equipped with the casing shoe. For example, FIG. 12 shows a construction in which an excavation tool 410 has no casing shoe. Such construction is also usable. Further, the external diameter of a skirt portion 423 of an excavation bit 420 may be set to be equal to the external diameter of a head portion 422.

Figure 13:
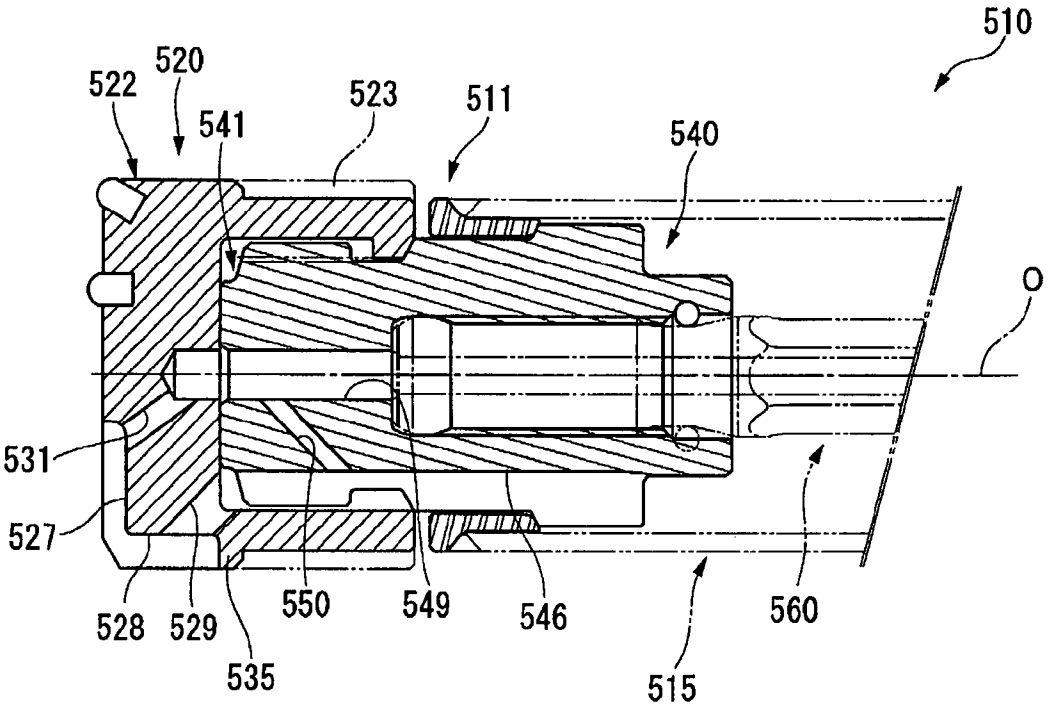
FIG. 13 is a partial side sectional view of an excavation tool that is a still further embodiment of the invention.

Additionally, FIG. 13 shows that an excavation tool 510 in which a casing shoe 511 and an excavation bit 520 do not engage with each other, but have a space provided between them. Such excavation tool is also usable.

Figure 14:
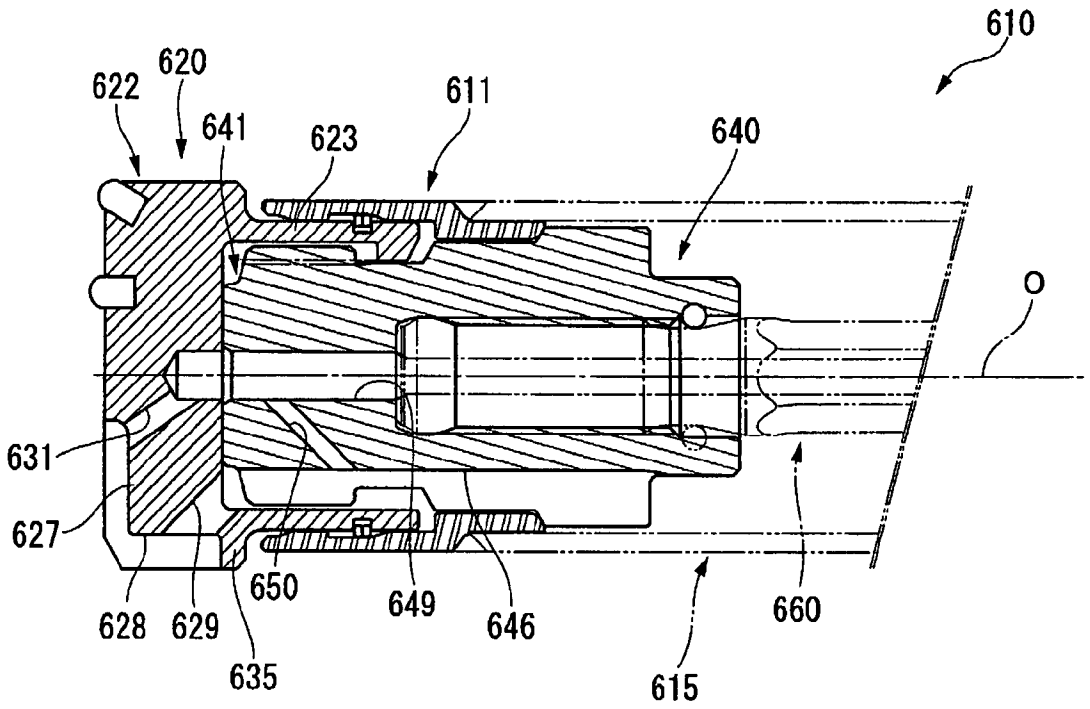
FIG. 14 is a partial side sectional view of an excavation tool that is a still further embodiment of the invention.

Further, for example, FIG. 14 shows that an excavation tool 610; in which a space is provided between the rear end surface of a skirt portion 623 of an excavation bit 620 and a device 640, and also the excavation bit 620 has a structure for receiving the impact only from the tip portion of the device 640. Such excavation tool is also usable.

The invention claimed is:

1. An excavation tool comprising:

an excavation bit arranged on a tip portion of a casing pipe; and a device which is arranged inside the casing pipe and inside the excavation bit coaxial to an axis, and receives impact, thrust, and rotational force from the excavation tool:

wherein the device has: a discharge flute, which is for discharging waste rocks produced during excavation and is formed in an outer peripheral surface along the axis toward a rear end side; and also has a fluid supply hole which extends along the axis, wherein the excavation bit includes:

a tip face formed by a flat surface portion connected to a skirt portion extending in a direction opposite from the tip face and the skirt portion receiving a part of the device therein and receiving the rotational force, thrust, and impact from the device;

a fluid discharge hole, which is connected to the fluid supply hole of the device and is open into the tip face of the excavation bit;

a face flute, which is formed in the tip face of the excavation bit and extends radially outward;

a connection flute which is formed in an outer peripheral surface of the excavation bit, is integrally connected to an outer peripheral end of the face flute, and extends toward the rear end side; and an intake hole, which is open from the connection flute into an inner peripheral side of the skirt portion, and wherein a shield wall which greatly extends radially outward beyond a casing shoe, is formed at a rear end of the connection flute.

2. The excavation tool according to claim 1, wherein the device is provided with a fluid emission hole; which gradually goes toward the rear end side as it goes radially outward from the fluid supply hole, and is open into the discharge flute.

3. The excavation tool according to claim 2, wherein the fluid emission hole is located inward in the inner periphery side of the skirt portion of the excavation bit.

4. The excavation tool according to claim 3, comprising:

a loading portion, which is formed at the tip of the device and is to be inserted into the skirt portion of the excavation bit; and a fluid emission hole which is provided in the loading portion.

5. The excavation tool according to claim 2, comprising:

a loading portion, which is formed at the tip of the device and is to be inserted into the skirt portion of the excavation bit; and a fluid emission hole which is provided in the loading portion.

6. The excavation tool according to claim 1, wherein the device is provided with a fluid emission hole; which gradually goes toward the rear end side as it goes radially outward from the fluid supply hole, and is open into the discharge flute.

7. The excavation tool according to claim 6, wherein the fluid emission hole is located inward in the inner periphery side of the skirt portion of the excavation bit.

8. The excavation tool according to claim 7, comprising:

a loading portion, which is formed at the tip of the device and is to be inserted into the skirt portion of the excavation bit; and a fluid emission hole which is provided in the loading portion.

9. The excavation tool according to claim 6, comprising:

a loading portion, which is formed at the tip of the device and is to be inserted into the skirt portion of the excavation bit; and a fluid emission hole which is provided in the loading portion.

10. The excavation tool according to claim 1, comprising:

a loading portion, which is formed at the tip of the device and is to be inserted into the skirt portion of the excavation bit; and a fluid emission hole which gradually goes toward the rear end side in proportion as the fluid emission hole goes radially outward from the fluid supply hole, is open into the discharge flute, and is provided in the loading portion.

11. The excavation tool according to claim 1, wherein the excavation bit comprises a head portion and the skirt portion; and the head portion comprises the tip face, the fluid discharge hole, the face flute, the connection flute and the intake hole.

12. The excavation tool according to claim 1, wherein the excavation bit comprises a head portion and the skirt portion;

the head portion comprises the tip face, the fluid discharge hole, the face flute, the connection flute, the intake hole and the shield wall; and the shield wall is formed at a rear end of the head portion.

13. An excavation bit used with the excavation tool according to claim 1, wherein: the intake hole is connected to the discharge flute of the device.

* * * * *